United States Patent [19]

Voltmer et al.

[11] Patent Number: 4,605,459

[45] Date of Patent: Aug. 12, 1986

[54] LITERATURE APPLYING MACHINE AND METHOD

[75] Inventors: Helmut Voltmer, Park Ridge; Alfred F. Schwenzer, Totowa, both of N.J.

[73] Assignee: New Jersey Machine Inc., Fairfield, N.J.

[21] Appl. No.: 576,730

[22] Filed: Feb. 3, 1984

[51] Int. Cl.[4] ..... B65B 19/34

[52] U.S. Cl. ..... 156/215; 53/415; 53/137; 156/256; 156/265; 156/322; 156/489; 156/521; 156/566; 156/568

[58] Field of Search ..... 156/489, 490, 566, 568, 156/486, 519, 521, 522, 499, 212, 215, 250, 256, 264, 265, 322; 53/415, 137

[56] References Cited

U.S. PATENT DOCUMENTS

| | | | |
|---|---|---|---|
| 2,107,311 | 2/1938 | Strickler | 156/521 X |
| 3,030,262 | 4/1962 | Gunter | 156/489 X |
| 3,138,500 | 6/1964 | Fairest | 156/285 X |
| 3,531,354 | 9/1970 | Hetzinger | 156/521 X |
| 3,532,583 | 10/1970 | Thiele | 156/521 |
| 4,233,331 | 1/1980 | Lemke et al. | 156/521 X |
| 4,293,369 | 10/1981 | Dilot et al. | 156/521 |
| 4,384,915 | 5/1983 | Utsumi | 156/521 X |

*Primary Examiner*—David Simmons

*Attorney, Agent, or Firm*—Charles E. Baxley

[57] ABSTRACT

A system for securing literature to a container by means of a band segment includes a supply of banding material, drawing rollers for drawing out a predetermined length of band segment and a knife for cutting it off. A dispenser of the literature and a conveyor of containers are set in proximity with a carousel which carries an applicator head. The applicator head picks up the band segment by suction, then receives the literature by further use of suction, and finally places the literature and the band segment against the container by release of the suction and a sweeping movement of arms extending from the applicator head to the container. The band segment is supplied with a thermo-sensitive adhesive for effecting an adhesive bond to the container. The applicator head includes heaters for activating the adhesive over only that portion of the band segment which is to adhere to the container.

15 Claims, 4 Drawing Figures

LITERATURE APPLYING MACHINE AND METHOD

BACKGROUND OF THE INVENTION

This invention relates to packaging equipment and, more particularly, to a banding system for applying literature, such as folded matter, to the outside of packages and containers by use of an adhesive band which is secured about the literature and to the package or container.

Containers of various shapes are employed in the marketplace for storage of various items ranging from food and drugs to other items, such as hardware, which is utilized in the home. The containers may be in the form of a paper box, or may be in the form of a bottle having a cap thereon and being formed with curved or flat sides. Information as to the contents of the container and/or as to directions for use is provided by printing on the container itself or by use of a label which is affixed to the container. When still further information is required, such further information is provided by a literature packet, sometimes referred to as an "outsert" which is secured to the container.

A problem exists in that securing of the outsert literature to the container may not be accomplished as readily and expeditiously as is desirable in packaging facilities employing automated equipment for filling and closing of packages. Typically, such automated equipment is employed with containers having the familiar shapes seen in the market place. As an example of the problem, it is well known that such literature may be affixed to a container by means of rubber bands, and that such a mode of banding readily is accomplished manually. However, in an automated facility it is most desirable that securing of the literature to the container be accomplished at a rate commensurate with other steps in the packaging operation.

SUMMARY OF THE INVENTION

The foregoing problem is overcome and other advantages are provided by a banding system, incorporating the invention, for securing of literature to containers by means of an adhesive band. The invention includes machinery for advancing a portion of the band from a supply roll, cutting a predesignated length of the band, lifting a piece of the literature, and successively applying the literature and the length of band to one of the containers as it passes by, usually on a conveyor. The band is formed of a theremo-sensitive material and is, accordingly, activated by heating. The machinery of the invention includes applicators for handling the band, and the applicators advantageously may incorporate heating elements for heating the bands, so as to activate their adhesive properties. In a preferred embodiment of the invention, the applicators are carried by a carousel which brings each of the applicators cyclically in contact with a section of the banding material, with the literature, and with the container positioned on the conveyor.

BRIEF DESCRIPTION OF THE DRAWINGS

The foregoing and other features and advantages of the invention are explained in the following description, taken in connection with the accompanying drawings, wherein.

DETAILED DESCRIPTION

Figure 1:
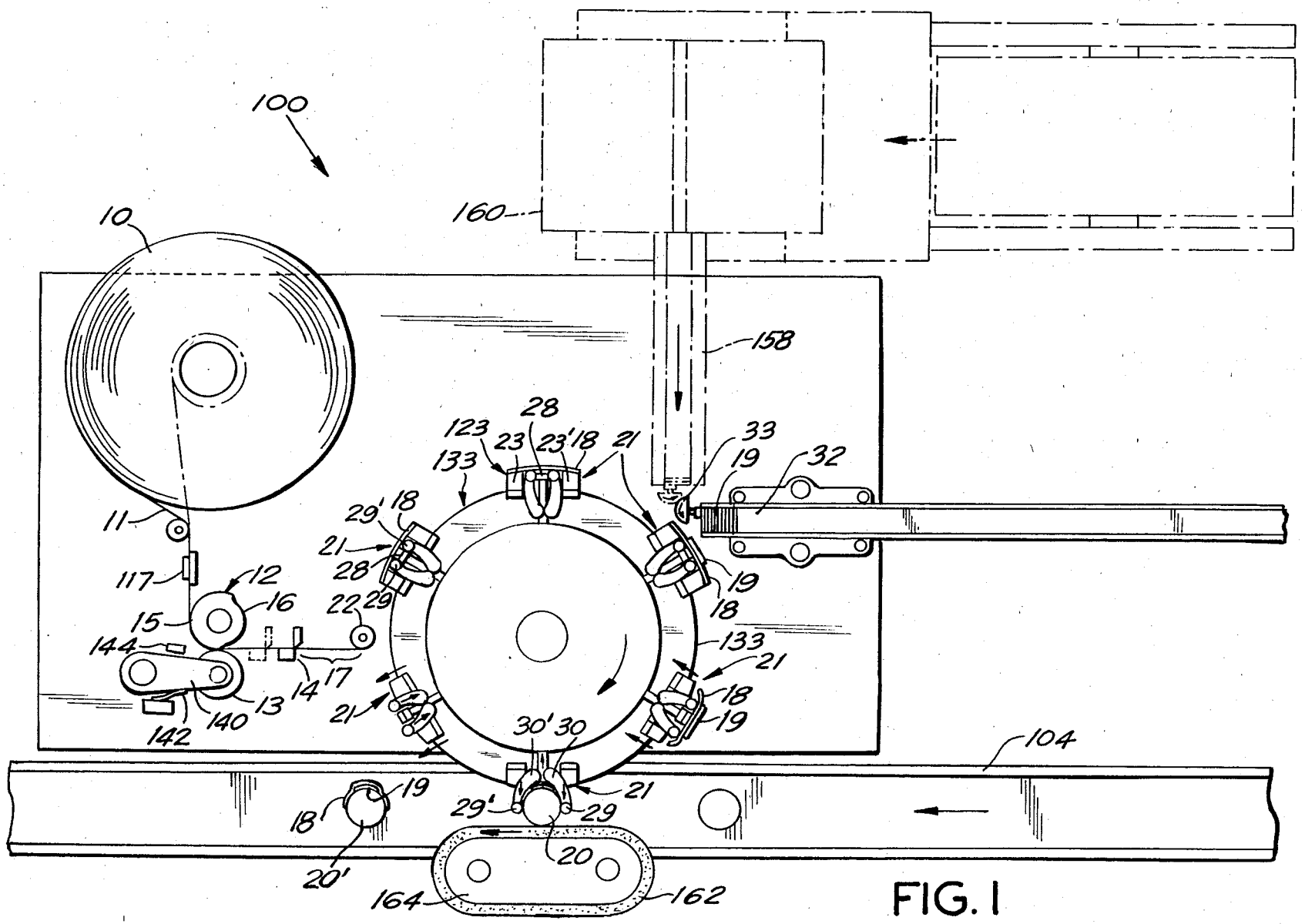
FIG. 1 is a plan view of a banding system incorporating the invention, the view showing a carousel carrying band applicators for applying the bands to containers carried on a conveyor.

With reference to the figures, there is shown a banding system 100 incorporating the invention for securing literature to sides of containers by means of thermo-sensitive bands. The system 100 is utilized in conjunction with a conveyor 104 of the containers, and includes a carousel 133 disposed alongside the conveyor 104 for affixing the literature to the containers. The novel features of the invention will be understood better with reference to specific details of construction of the system 100.

The system 100 comprises a supply roll 10 of a thermosensitive band 11, the band 11 being drawn from the roll 10 by combined action of a feed roll 12 and a pressure roll 13 which is then loaded for contact with the feed roll 12. Pressure of a roll 13 against the feed roll 12 provides for secure frictional contact of the band 11 with the roll 12 so as to insure the drawing of the band 11 by the roll 12. The portion of the band 11 fed by the roll 12 is passed onto a knife 14 which cuts off a predetermined length of band. Operation of the knife 14 is synchronized with operation of the roll 12, so as to provide for the cutting of the band 11 at the appropriate instant of time to obtain desired lengths or segments of band. The mechanism for the operation of a knife, as well as devices for synchronizing such mechanism with rotation of the feed roll 12, are well known and have been deleted from the figures so as to portray better the essential elements of the invention.

In the construction of the feed roll 12, the outer periphery is structured of two portions 15 and 16, the portion 15 has an extended radius while the portion 16 has a reduced radius. Thereby the portion 15 makes contact with the pressure roll 13 while the portion 16 is retracted beyond the spring movement of the roll 13, so as to prevent contact between portion 16 and the roll 13. Thus, there is a drawing of the band 11 by the feed roll 12 only during the interval of time associated with contact between the portion 15 and the roll 13, there being no drawing of the band 11 during the duration of time when the portion 16 faces the roll 13. A drag pad 117 contacts the band 11 so as to provide a retarding frictional force against which the feed roll 12 must pull. The retarding force of the drag pad 117 insures that movement of the band 11 stops during the interval of time when the portion 16 is facing the pressure roll 13. The pressure roll 13 is supported at an end of an arm 140 which is urged by a spring 142 towards a stop 144. The stop 144 prevents the arm 140 from carrying the roll 13 up against the portion 16 of the feed roll 12.

Figure 2:
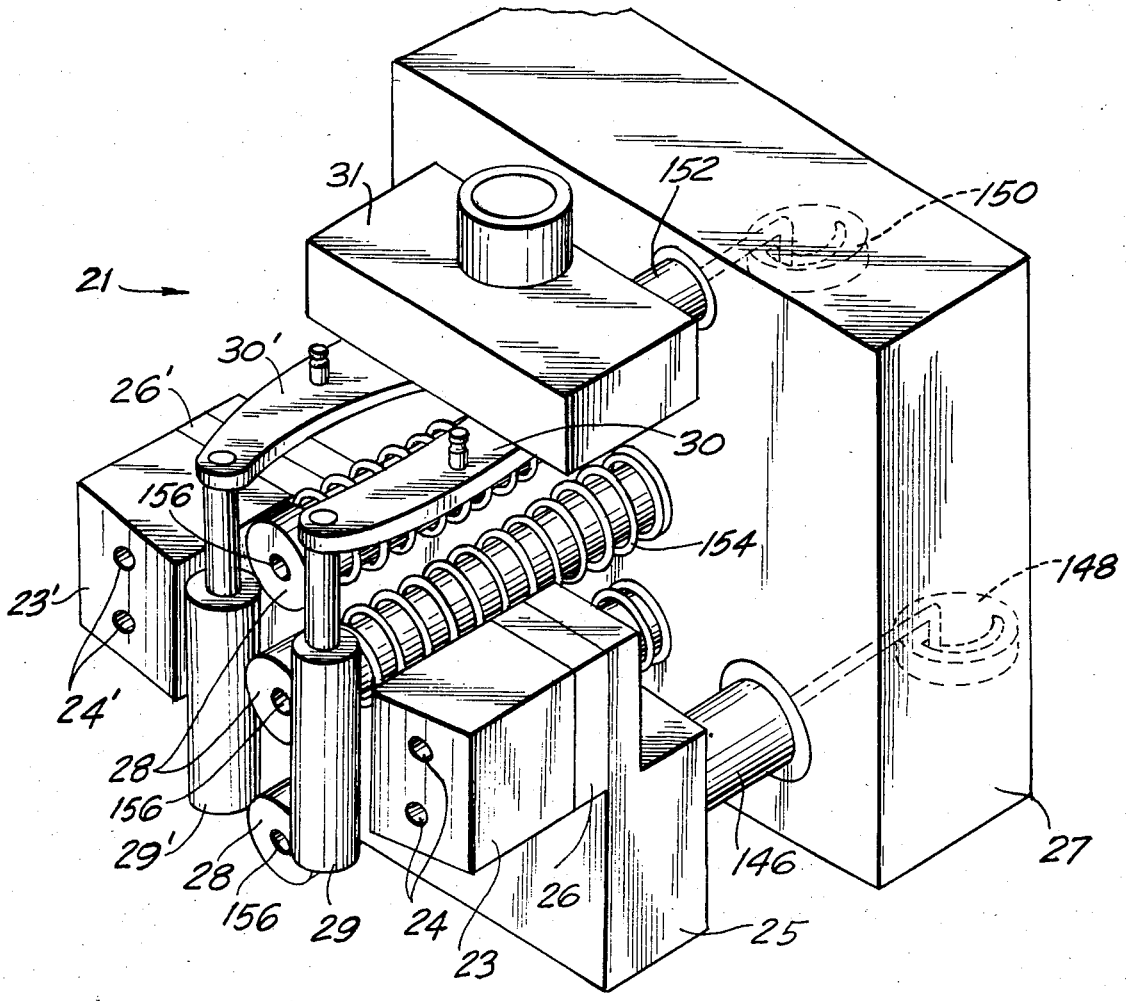
FIG. 2 is an enlarged isometric view of an applicator, or banding head, carried by the carousel of FIG. 1.
Figure 3:
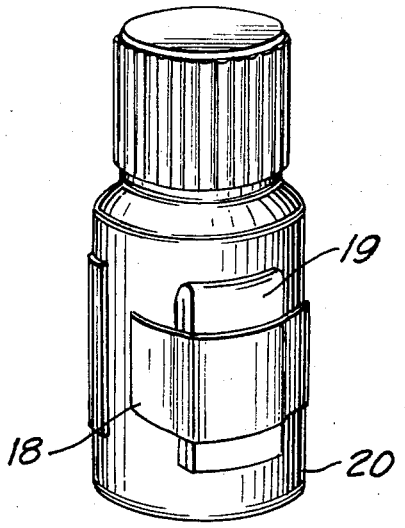
FIG. 3 shows securing of literature to a wall of a round bottle by means of a thermo-sensitive band of the invention.
Figure 4:
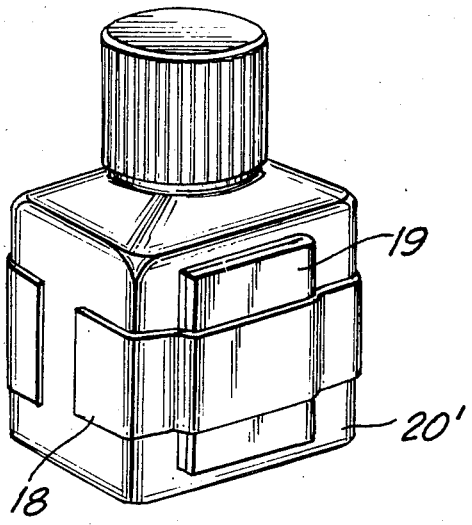
FIG. 4 shows securing of literature to a bottle having flat sides.

A length of the band which is cut off by the knife 14 is indicated in FIG. 1 as a segment 17 which protrudes beyond the knife blade, this portion becoming a band 18 which serves as the attaching medium of literature 19 to a container 20 as portrayed in FIG. 3 or the container 20' of FIG. 4. The protruding segment 17 is transferred from its cut-off position to one of several applicators which are transported in turn by the carousel 133 for transferring the segment 17 to a container 20 carried by the conveyor 104. Each of the applicators is constructed as a head 21 to which the band segment 17 is transferred with the aid of a transfer roll 22. The roll 22 is, in turn, driven intermittently by well known means (not shown) such as cyclo-index drive. After the protruding band segment 17 has been transferred by the roll 22 to the head 21, the head 21 holds the segment 18 in close contact to heater blocks 23,23' of a heater block assembly 123. The band segment 18 is held at its end portions against the assembly 123 by vacuum forces exerted through suction holes 24,24' in respective ones of heater blocks 23,23' (Fig.2). The heater blocks 23,23' are fastened to a heater block support 25 and thermally insulated therefrom by insulators 26,26'.

Operation of the heads 21 for acquiring and releasing a band segment 18 is accomplished by a retractable feature which operates as follows. The heater block support 25 is retractably mounted to an activating head block 27 to undergo a horizontal motion, as is necessitated by the various work stations positioned about the carousel 133. The heater block support 25 is mounted by a pair of arms 146 (one such arm being shown in the figure) which are slidably supported within the head block 27 and are movable in response to a cam drive 148.

Each head 21 further comprises a set of three outwardly spring-biased suction cups 28 and a pair of pressure rolls 29,29' which are mounted rotatably to spring-biased, pivotably mounted arms 30,30'. The arms 30,30' are supported by an arm support block 31 which in turn is slidably supported upon the head block 27. Adjustment of the position of the support block 31 relative to the head block 27 is provided by a cam drive 150 acting through a shaft 152 which extends from the head block 27 to provide a slidable support for the support block 31. Both of the cam drives 148 and 150 are shown in phantom in FIG. 2. The spring-biasing of the suction cups 28 is provided by springs 154 which encircle stem portions of the suction cups 28.

In operation, during transfer of the band segment 18 to the head 21 at the transfer roller 22, the suction cups 28 are fully extended so that the band segment 18 is then held firmly in position against the central one of the suction cups 28 by vacuum forces applied through the central one of the orifices 156. During this transfer, the pressure rolls 29,29' and the arms 30,30' from which they extend are fully retracted by the action of the cam 150 acting through the support block 31. As the band segment 18 is held securely by the central one of the suction cups 28 and the suction holes 24, 24', the carousel 133 rotates to carry the head 21 with its band segment 18 to the next work station, this being a literature supply hopper 32 or, alternatively, the exit chute 158 of a literature folding machine 160, shown in phantom. During rotation of the carousel 133, heat radiates from the blocks 23,23' to raise the temperature of the band segment 18 sufficiently for activating the adhesive of the band.

At the hopper 32, a transfer roller 33 having suction cups thereon transfers a piece of literature 19 from the hopper 32 to a head 21. The transfer roller 33 is driven in synchronism with the driving of the carousel 133 and with an intermittent motion, such as is provided by a well-known cyclo-index drive (not shown). The array of the suction cups 28 extends beyond the width of the band segment 18 so that only the central one of the suction cups 28 is holding the band segment 18 to the head 21. The remaining ones of the suction cups 28 are utilized for applying vacuum forces to the piece of literature 19 for holding the literature 19 to the head 21 after transfer thereto by the roller 33. It is noted that the heater blocks 23,23' are spaced apart, so as to heat the end portions of a band segment 18 without heating the midportion. Thereby the adhesive of the end portions is activated to stick to the container 20, while the adhesive of the midportion remains deactivated so as not to stick to the literature 19.

With still further rotation of the carousel 133, the head 21 carrying both the band segment 18 and the literature 19 approaches the next work station, this being the station wherein a container 20 sets upon a conveyor 104 for receiving the literature 19 and the adhesive action of the band segment 18. The applying of the literature 19 to the container 20 by the head 21 is accomplished as follows: The cam 148 imparts a retracting motion to the heater block assembly 123 and, simultaneously, the vacuum is cut off at the heater blocks 23,23' by well-known valving (not shown). A series of the containers 20 is located on the conveyor 104 with the containers 20 being spaced apart by distances equal to the spacing of the heads 21 about the periphery of the carousel 133. Thereby, as each container 20 arrives at the station for the application of the literature 19, the respective ones of the containers 20 are aligned with the respective ones of the heads 21. At the station, a back-up belt 162 circulates about a turret 164 and in contact with the container 20 so as to urge the container 20 against the springloaded suction cups 28. The cups 28 exert a pressure on the literature 19 and the band segment 18, the pressure being exerted by the force of the wall of the container 20 against the front faces of the suction cups 28. The cam 150 then drives the support block 31 outwardly to drive the arms 30,30' and their pressure rolls 29,29' against the band segment 18 and the container 20. The resulting movement of the rolls 29,29' along the container 20 forces the band segment 18 to encompass the container 20 and to adhere securely to the container 20. Thereby, the band segment 18 binds the literature 19 to the container 20. The operation is concluded by retraction of the vacuum forces of the suction cups 28 by means of well-known valving (not shown), so as to release the literature 19 and the encompassing band segment 18 from the suction cups 28.

With further rotation of the carousel 133, the cam drives 148 and 150 of the foregoing head 21 retract to their initial positions so as to initialize the positions of the mechanical elements of the head 21, and thereby prepare the head 21 to receive the next band segment 17 at the band transfer roller 22. The foregoing sequence of operational steps is the same irrespectively as to whether the literature 19 is applied via the chute 158 or via the hopper 32.

In view of the foregoing description of the invention, it should be appreciated readily that a container travelling along a conveyor can receive literature which is banded securely to the outer surface of the container. In addition, the mounting of the heads 21 on the carousel 133 provide for the ready transfer of sections of banding material and of pieces of literature from their respective dispensers to be applied to the container.

It is to be understood that the above described embodiment of the invention is illustrative only, and that modifications thereof may occur to those skilled in the art.

Accordingly, this invention is not to be regarded as limited to the embodiment disclosed herein, but is to be limited only as defined by the appended claims.

We claim:

1. A banding system, for securing literature to containers, the banding system comprising in combination;
   a supply of banding material including an adhesive for attachment to said containers;
   metering means for metering portions of said banding material from said supply to provide a band segment;
   a dispenser of literature;
   receiving means for receiving a band segment from said metering means and subsequently receiving said literature from said dispenser;
   coupling means for coupling said receiving means to a container; and wherein
   said receiving means includes dislodging means for dislodging said literature and said band segment upon said container, and
   a set of spring loaded suction cups one of which holds said band segment by vacuum force and a second of which holds said literature by vacuum force, and an articulated arm assembly for placing said literature and said band segment upon a container at said third station, the vacuum forces of said cups being terminated upon the placement of the literature and the band segment upon the container.

2. The banding system according to claim 1, and wherein said metering means comprises a set of rollers one of which is of varying radius for intermittent drawing of the banding material, and a knife operatively connected to said set of rollers for cutting off said band segments of said banding material at the conclusion of a drawing of said band segments.

3. The banding system according to claim 1, and wherein said dispenser includes a roller and a suction means for lifting the literature onto said receiving means.

4. The banding system according to claim 1, and wherein:
   said coupling means comprises a carousel, and wherein said receiving means is supported on said carousel;
   said receiving means including a head having spring-loaded suction cups extending therefrom, one of said suction cups holding said band segment.

5. The banding system according to claim 4, and wherein said dislodging means incorporates a set of rollers supported by arms extending pivotably from said head, said pivoting of said arms driving said rollers across said container for securing a band segment thereto with said band segment enclosing said literature for holding said literature against said container.

6. The banding system according to claim 5, and wherein:
   said metering means comprises a set of rollers, one of said rollers being of varying radius for intermittent contact with another of said rollers, said set of rollers drawing said band segment from said supply, said intermittent contact providing an intermittent drawing of the banding material, said metering means further comprising a knife operatively coupled to the intermittent drawing operation of said rollers for cutting off said band segments at the conclusion of a drawing of said band segments; and wherein said dispenser includes a roller and suction means for lifting literature onto said receiving means.

7. The banding system according to claim 6, and wherein said literature is held by individual ones of said spring loaded suction cups of said head, and wherein said suction is terminated upon operation of said dislodging means.

8. A banding system for securing literature to a container comprising:
   a dispenser of banding material at a first station;
   a dispenser of literature at a second station;
   a conveyor of containers at a third station;
   carousel means for coupling said stations, said carousel means including applicator means for sequentially receiving a band segment and literature at said first two stations and applying said band segment and said literature to a container at said third station;
   said band segment including an adhesive for adherence to the container for securing the literature thereto,
   wherein said applicator means includes a set of spring-loaded suction cups one of which holds said band segment by vacuum force and a second of which holds said literature by vacuum force, and an articulated arm assembly for placing said literature and said band segment upon a container at said third station, the vacuum forces of said cups being terminated upon the placement of the literature and the band segment upon the container.

9. The banding system according to claim 8, and wherein said dispenser of banding material comprises:
   a supply roll of banding material;
   a set of rollers for drawing said banding material from said supply roll, one of said rollers being of varying radius for intermittent contact with another of said rollers to provide for an intermittent drawing of the banding material by said set of rollers; and
   a knife operatively coupled to said set of rollers for cutting off a band segment of said banding material at the conclusion of the drawing of said band segment.

10. The banding system according to claim 9, and wherein said dispenser of literature includes a roller and suction means for lifting literature onto said applicator means.

11. A system according to claim 8, and wherein said adhesive is a thermo-sensitive adhesive activated by the application of heat, and wherein said applicator means holds said literature in a central portion of said band segment with peripheral portion of said band segment extending beyond said literature; and wherein
   said applicator means comprises heating means spaced apart for heating only the peripheral regions of said band segment without the application of heat to a central portion of the band segment contacting the literature, such heating of the peripheral portions of the band segment providing for adhesion of the peripheral regions of the band segment to the container at said third station without introducing a sticking between said literature and said band segment.

12. A method of securing literature to a container and comprising steps of:
   severing an imperforate band segment at a predetermined length including end portions, from a source of banding material having a thermo-sensitive adhesive everywhere on one face thereof;

placing the literature against said one face of the band segment in an overlapping area with the end portions of the band segment extending beyond the literature and with a portion of the literature extending beyond the band segment and holding the literature and the band segment together by applying suction to the band segment, but not the literature in the overlapping area, and to the end portions of the band segment and to the extending portion of the literature;

heating the end portions of the band segment without heatint the mid portion to activate the adhesive on said end portions but not the adhesive on the mid portion; and pressing the end portions of the band segment against the container with the literature between the band segment and the container.

13. A banding system for securing a piece of literature to an object by means of an imperforate band segment having first and second lateral edges, said system including receiving means for holding said piece of literature and said segment against each other in an overlapping area with the end portions of said band segment extending beyond said piece of literature and said piece of literature extending beyond said first lateral edge, said receiving means including a vacuum source having a first portion for applying suction directly to said band segment but not to said piece of literature in said overlapping area and to the end portions of said band segment and a second portion for applying suction directly to said piece of literature but not to said band segment beyond said first lateral edge.

14. A system according to claim 13, wherein said vacuum source comprises a plurality of separated suction cups one of which is positioned for direct engagement with said band segment and another of which is positioned for direct engagement with said piece of literature.

15. A system according to claim 13, wherein said piece of literature extends beyond said second lateral edge and said vacuum source comprises three separated aligned suction cups the central one of which is positioned for direct engagement with said band segment and the others of which are positioned for direct engagement with said piece of literature beyond said lateral edges.

* * * * *